US007452115B2

(12) United States Patent
Alcelik

(10) Patent No.: US 7,452,115 B2
(45) Date of Patent: Nov. 18, 2008

(54) HEADLAMP WITH A CONTINUOUS LONG-DISTANCE ILLUMINATION WITHOUT GLARING EFFECTS

(76) Inventor: Turhan Alcelik, Cukuranbar Mah. 44 d. 457 Sk., No. 2/26 Balgat, Ankara (TR) 06530

( * ) Notice: Subject to any disclaimer, the term of this patent is extended or adjusted under 35 U.S.C. 154(b) by 99 days.

(21) Appl. No.: 10/566,623

(22) PCT Filed: Jul. 29, 2003

(86) PCT No.: PCT/TR03/00063

§ 371 (c)(1),
(2), (4) Date: Jul. 14, 2006

(87) PCT Pub. No.: WO2005/010430

PCT Pub. Date: Feb. 3, 2005

(65) Prior Publication Data

US 2007/0115679 A1 May 24, 2007

(51) Int. Cl.
*F21V 7/00* (2006.01)

(52) U.S. Cl. ..... 362/516; 362/517; 362/518; 362/538; 362/539; 362/512

(58) Field of Classification Search ..... 362/512, 362/516, 517, 518, 538, 539
See application file for complete search history.

(56) References Cited

U.S. PATENT DOCUMENTS

| | | | |
|---|---|---|---|
| 1,300,202 | A | 4/1919 | Stubblefield |
| 1,328,692 | A | 1/1920 | Richard |
| 1,614,027 | A | 1/1927 | Graf |
| 1,683,896 | A | 9/1928 | Jacob |
| 1,814,669 | A | 7/1931 | Cushing |
| 1,965,869 | A | 7/1934 | Walch |
| 2,185,203 | A | 1/1940 | Lanoue |
| 2,215,203 | A | 9/1940 | Young |
| 2,516,377 | A | 7/1950 | Fink |
| 3,598,989 | A | 8/1971 | Biggs |
| 3,643,081 | A | 2/1972 | Szeles |
| 3,876,285 | A | 4/1975 | Schwarzmuller |

(Continued)

FOREIGN PATENT DOCUMENTS

| | | |
|---|---|---|
| DE | 4417675 | 11/1995 |

(Continued)

*Primary Examiner*—Sandra O'Shea
*Assistant Examiner*—James W Cranson
(74) *Attorney, Agent, or Firm*—Akerman Senterfitt

(57) ABSTRACT

A headlamp developed especially for motor vehicles based on the exact adjustment of the height of the light plane by total concealing the light source and all direct and indirect reflecting surfaces and by using the principle of the half-lens illumination described in this invention. The most preferred embodiment of this invention consists of a single standard light source (1), a reflector group of three units (2,3; 12,13; 22,23) forming a structure similar to a clover-leaf with each unit having its own light pathway, three plano-convex lenses (27,7,17), three flat mirrors (25,5,15), three movable semi-shutters (26,6,16) covering the upper halves of the plano-convex lenses, with the addition of a shield (9) and a reflective surface in the forward-looking part of this embodiment. The basic illumination principle defined above may be applied to headlamp designs with a single or multiple reflectors, or without a lens in the headlamp structure, and without any limitation in the number or direction of the reflectors.

47 Claims, 5 Drawing Sheets

U.S. PATENT DOCUMENTS

| | | | |
|---|---|---|---|
| 3,935,444 | A | 1/1976 | Zechnall et al. |
| 4,089,047 | A | 5/1978 | Luderitz |
| 4,302,698 | A | 11/1981 | Kiesel et al. |
| 4,366,409 | A | 12/1982 | Nieda et al. |
| 4,391,847 | A | 7/1983 | Brown |
| 4,456,948 | A | 6/1984 | Brun |
| 4,577,260 | A | 3/1986 | Tysoe |
| 4,594,529 | A | 6/1986 | de Vrijer |
| 4,605,991 | A | 8/1986 | Fylan |
| 4,620,269 | A | 10/1986 | Oyama |
| 4,802,067 | A | 1/1989 | Ryder et al. |
| 4,839,779 | A | 6/1989 | Kasboske |
| 5,045,748 | A | 9/1991 | Ahlgren et al. |
| 5,077,642 | A | 12/1991 | Lisak |
| 5,077,649 | A | 12/1991 | Jackel et al. |
| 5,081,564 | A | 1/1992 | Mizoguchi et al. |
| 5,124,891 | A | 6/1992 | Blusseau |
| 5,278,731 | A | 1/1994 | Davenport et al. |
| 5,414,601 | A | 5/1995 | Davenport et al. |
| 5,483,430 | A | 1/1996 | Stapel et al. |
| 5,688,044 | A | 11/1997 | Watanabe et al. |
| 5,944,415 | A | 8/1999 | Kurita et al. |
| 6,007,223 | A | 12/1999 | Futami |
| 6,070,999 | A | 6/2000 | Kamps et al. |
| 6,109,772 | A | 8/2000 | Futami et al. |
| 6,152,589 | A | 11/2000 | Kawaguchi et al. |
| 6,168,302 | B1 | 1/2001 | Hulse |
| 6,220,736 | B1 | 4/2001 | Dobler et al. |
| 6,244,731 | B1 | 6/2001 | Koiko et al. |
| 6,375,341 | B1 | 4/2002 | Denley |
| 6,386,744 | B1 | 5/2002 | Scholl |
| 6,416,210 | B1 | 7/2002 | Uchida |
| 6,422,726 | B1 | 7/2002 | Tatsukawa et al. |
| 6,428,195 | B1 | 8/2002 | Ohshio et al. |
| 6,430,799 | B1 | 8/2002 | Ballard et al. |
| 6,440,334 | B2 | 8/2002 | Currens et al. |
| 6,457,850 | B2 | 10/2002 | Oyama et al. |
| 6,504,285 | B2 | 1/2003 | Toda et al. |
| 6,513,958 | B2 | 2/2003 | Ishikawa |
| 6,534,118 | B1 | 3/2003 | Nakamura et al. |
| 6,543,910 | B2 | 4/2003 | Taniuchi et al. |
| 6,543,916 | B2 | 4/2003 | Shirai |
| 6,558,026 | B2 | 5/2003 | Strazzanti |
| 6,570,302 | B1 | 5/2003 | Boonekamp et al. |
| 6,572,248 | B2 | 6/2003 | Okuchi et al. |
| 6,796,696 | B2 * | 9/2004 | Taniuchi ..... 362/539 |
| 2003/0081424 | A1 | 5/2003 | Albou et al. |

FOREIGN PATENT DOCUMENTS

| | | |
|---|---|---|
| EP | 0 949 449 | 10/1999 |
| EP | 1 213 532 | 6/2002 |
| FR | 539 045 A | 6/1922 |
| FR | 539045 | 6/1922 |
| FR | 2 627 845 | 9/1989 |
| FR | 2 668 434 | 4/1992 |
| FR | 2 705 434 | 11/1994 |
| FR | 2 808 867 | 11/2001 |
| GB | 446358 | 4/1936 |
| GB | 2 149 077 | 6/1985 |
| JP | 08-335402 | 12/1996 |

* cited by examiner

HEADLAMP WITH A CONTINUOUS LONG-DISTANCE ILLUMINATION WITHOUT GLARING EFFECTS

BACKGROUND OF THE INVENTION

1. Field of the Invention

This present invention relates generally to applications where it is desired to eliminate glaring effects of light on the eyes, and more specifically, to motor vehicle headlamps in order to obtain a continuous long-distance illumination without any glaring effects on the oncoming traffic and pedestrians during nighttime driving.

2. Detailed Description of the Prior Art

Numerous studies have been conducted on motor vehicle headlamps in order to provide a good illumination on the road surface in any type of weather and road conditions while ensuring the light beam does not cause any glaring on the eyes of the oncoming traffic users.

Below is the summary of studies conducted in this field;

Using a projection type headlamp (for example, U.S. Pat. No. 1,614,027 to R. Graf; U.S. Pat. No. 2,215,203 to Young; U.S. Pat. No. 6,007,223 to Futami; U.S. Pat. No. 6,220,736 to Dobler, et al.; and U.S. Pat. No. 6,416,210 to Uchida), Using movable reflectors or headlamp (for example, U.S. Pat. No. 5,077,642 to Lisak; and U.S. Pat. No. 6,543,916 to Shirai), Using various types of light sources such as incandescent, halogen, HID, or colored light sources, or optical fiber etc. (for example, U.S. Pat. No. 4,302,698 to Kiesel, et al.; U.S. Pat. No. 4,366,409 to Nieda, et al.; U.S. Pat. No. 4,594,529 to Bertus; U.S. Pat. No. 4,839,779 to Kasboske; U.S. Pat. No. 5,045,748 to Ahlgren, et al.; U.S. Pat. No. 5,278,731 to Davenport, et al.; and 6,168,302 to Hulse), Using anti-glare shields (for example, U.S. Pat. No. 6,375,341 to Denley; U.S. Pat. No. 6,386,744 to Scholl; U.S. Pat. No. 6,422,726 to Tatsukawa, et al.; U.S. Pat. No. 6,428,195 to Ohshio, et al.; U.S. Pat. No. 6,430,799 to Ballard, et al. and FR. Pat. No 2808867 to Reiss Benoit), Coating the light source, reflector surfaces or lens with micro particles, film forming layers and similar substances (for example, U.S. Pat. No. 4,391,847 to Brown; U.S. Pat. No. 6,440,334 to Currens, et al.; U.S. Pat. No. 6,534,118 Nakamura, et al.; and U.S. Pat. No. 6,570,302 to Boonekamp, et al.), Forming special diffractive sections on the front lens (for example, U.S. Pat. No. 4,577,260 to Tysoe; U.S. Pat. No. 5,081,564 to Mizoguchi et al.; and U.S. Pat. No. 5,688,044 to Watanabe, et al.), Using plurality face reflector surfaces, (for example, U.S. Pat. No. 5,483,430 to Stapel, et al.; and U.S. Pat. No. 5,944,415 to Kurita et al.), Indirect illumination using reflective mirrors where the light source and reflectors are concealed (for example, U.S. Pat. No. 1,300,202 to Stubblefield; U.S. Pat. No. 1,683,896 to Jacob; U.S. Pat. No. 2,516,377 to Fink; U.S. Pat. No. 4,089,047 to Luderitz; U.S. Pat. No. 4,456,948 to Brun; U.S. Pat. No. 4,605,991 to Fylan; U.S. Pat. No. 4,620,269 to Oyama; U.S. Pat. No. 6,457,850 to Oyama, et al.; U.S. Pat. No. 5,414,601 to Davenport, et al.; FR. Pat. No 2668434 to Fayolle; and JP. Pat. No 7-164500 to Goto Shinichiro et. al), Using duct-type headlamp assembly (for example, U.S. Pat. No. 1,328,692 to Richard; U.S. Pat. No. 1,965,869 to Walch; U.S. Pat. No. 3,643,081 to Szeles; and U.S. Pat. No. 6,070,999 to Kamps, et al.), Using polarization methods on front lens or reflector or windshield (for example, U.S. Pat. No. 3,876,285 to Schwarzmuller; U.S. Pat. No. 3,935,444 to Zechnall, et al.; DE. Pat. No 4417675 to Roeseler Olaf; and FR Pat. No 2705434 to Joel Leleve), Using shutters, louvers or masking devices in front of light source, reflectors or front lens (for example, U.S. Pat. No. 3,598,989 to Orric H. Biggs; U.S. Pat. No. 5,077,649 to Jackel, et al.; U.S. Pat. No. 5,124,891 to Blusseau; U.S. Pat. No. 6,109,772 to Futami, et al.; U.S. Pat. No. 6,543,910 to Taniuchi, et al.; U.S. Pat. No. 6,558,026 to Strazzanti; 20030081424 to Abou Pierre, et al.; GB. Pat. Nos. 446358 to Mcnaught; and 2149077 to Longchamp, et al.; and FR. Pat. No 2627845 to Laribe Armand), Using headlamp-leveling devices (for example, U.S. Pat. No. 4,802,067 to Ryder, et al.; U.S. Pat. No. 6,504,265 to Toda, et al.; U.S. Pat. No. 6,513,958 to Ishikawa; and U.S. Pat. No. 6,572,248 to Okuchi et al.), While some of these arts provide sufficient illumination, they fail to prevent glaring effects, and others prevent glaring completely, but fail to ensure sufficient light intensity at appropriate distances or at least they cause the loss of part of the lights generated.

Any obstructions or masking materials (shutters, louvers, bulb shields, reflector shields, anti-glare shields, etc.) placed in the light pathway, or any special paint or coating applied to the light source or to reflector surfaces or other similar methods (such as polarization, film layers, micro particles on reflector surfaces or on cover lens or on the windshield, etc.) absorbing some portions of the light rays reduce photometric measurements of the illumination. Since the light shield disposed in front of the reflector surface blocks part of the generated light rays in conventional projection type headlamp designs, illumination intensity is reduced and a full glare control may not be provided.

In some of the previous arts that are similar to our invention, the light source and the reflecting surfaces are not fully concealed from the opposite traffic, and thus glaring effects cannot completely be eliminated. Other works provide total concealing with shutters, louvers, shields, or with the upper or lower walls of the reflectors behaving as flat reflecting surfaces designed parallel to the road surface or with indirect illumination methods where a flat mirror disposed at the upper section of the headlamp housing is used as the main reflecting surface and parallel to road surface. However, since it is not possible to obtain a parallel light beam in any of these methods, they fail to provide a sufficient illumination at desired distances.

In the present invention, the light source and all the direct and indirect reflecting surfaces are totally concealed from the opposite traffic, and since the design presented herein ensures a full adjustment of the height of the light plane, a fully non-glare headlamp system with a light projection at desired intensity and with a long-distance illumination is obtained.

SUMMARY OF THE INVENTION

In order to resolve said conventional problems, the present invention provides a headlamp design wherein the light source and all the direct and indirect reflecting surfaces are totally concealed from the opposite traffic, and the light generated by a light source is reflected and focused by specially designed reflectors or reflecting surfaces and then directed to a plano-convex lens, the upper half of which is closed with a semi-shutter and only the lower half is utilized to ensure that the light rays are horizontal to the travel direction and do not pass above the horizontal light plane, providing an half-lens illumination with the exact adjustment of the height of the light plane.

The most preferred embodiment of this invention consists of a single standard light source, a reflector group of three units forming a triple light pathway structure similar to a clover-leaf, with each unit having its own light pathway comprised of reflector surfaces, a piano-convex lens and a movable semi-shutter covering the upper half of the said plano-convex lens, thereby allowing to utilize in the most efficient manner the light generated by the light source for illumination.

The headlamp in the present invention, thanks to the inner design, ensures a total concealment of the light source and all the direct and indirect reflecting surfaces, therefore causing no glaring effects on the oncoming traffic, while providing an even better illumination compared with conventional headlamp designs, since it allows the utilization of nearly all the light generated by the light source.

Another object of this invention is to obtain combined positive effects of vehicle approaching vehicle each other, and to improve the view distance and the vision quality for vehicles traveling in the same direction as well as for opposing vehicles.

A further object of this invention is to ensure a headlamp design that allows the rearview mirror to be used in "daytime view" mode during nighttime driving, thus providing a safer and more comfortable driving.

Further objects of the invention will appear as the description proceeds.

In order to achieve the above and other related objects, the present invention may be designed in the form of the embodiments illustrated in the accompanying drawings, but it should be noted that the said drawings are exemplary and that they may be extended within the scope of the appended claims.

DETAILED DESCRIPTION OF THE PREFERRED EMBODIMENTS

In this section, operational principles and advantages of some of the preferred embodiments of the present invention are presented together with the drawings in order to allow better understanding of the headlamp system in this invention. The present invention, as can be seen from the figures, can be applied in various ways to several headlamp types, however, whichever design is chosen, the main principle of the operation is the same. It should be reminded that the terms referring to directions such as forwards, backwards, upwards, downwards, horizontal and vertical in the present invention are based on a vehicle to which the headlamp in this invention is mounted, unless otherwise defined. The triple light pathway (clover-leaf shape) design is preferred in order to utilize in the most efficient manner the light generated by the light source for illumination.

Figure 1:
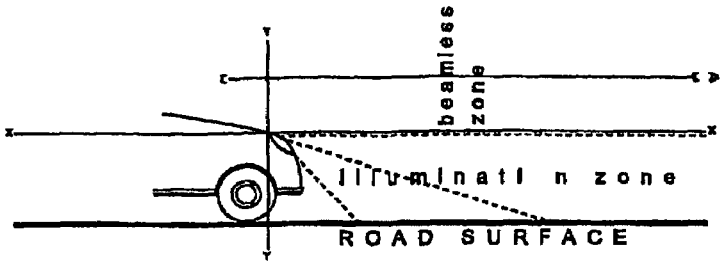
FIG. 1 shows a sketch to explain the main operational principle of the headlamp in this invention.
Figure 2:
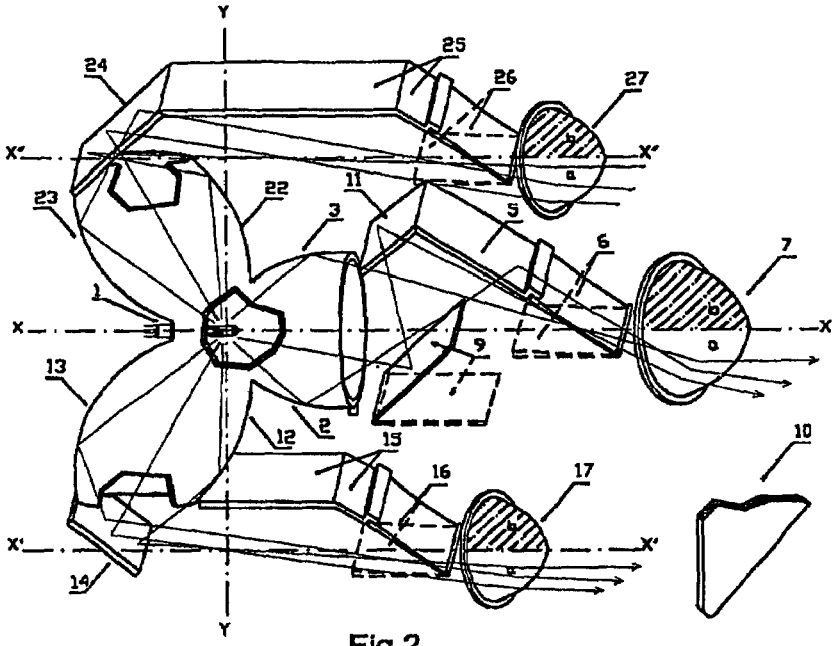
FIGS. 2 and 4 are the perspective views showing the essential parts of a first preferred embodiment in this invention, consisting of one horizontally and two vertically disposed reflectors and three light pathways, mounted in the form of a cloverleaf (triple light pathway), with the semi-shutter piece in closed and open positions respectively.
Figure 3:
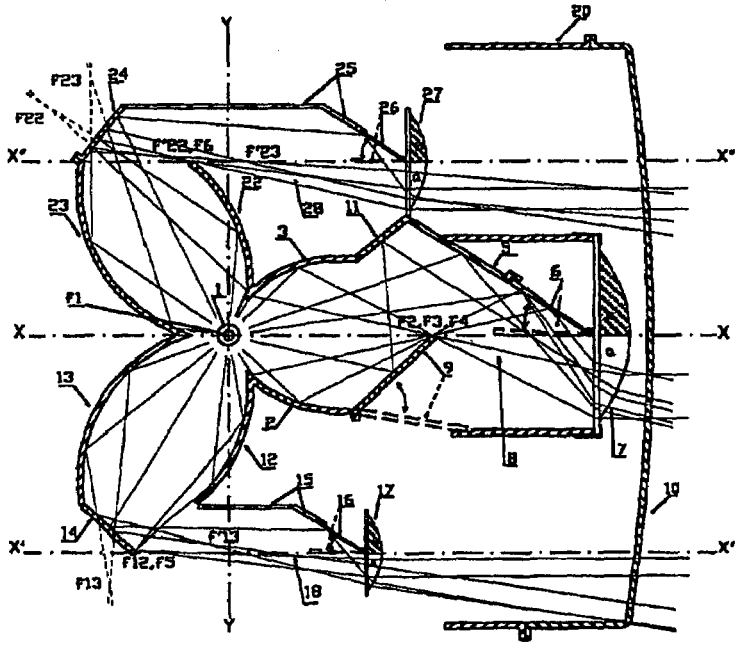
FIGS. 3 and 5 are cross-sectional views in the vertical direction of FIGS. 2 and 4 above respectively.
Figure 4:
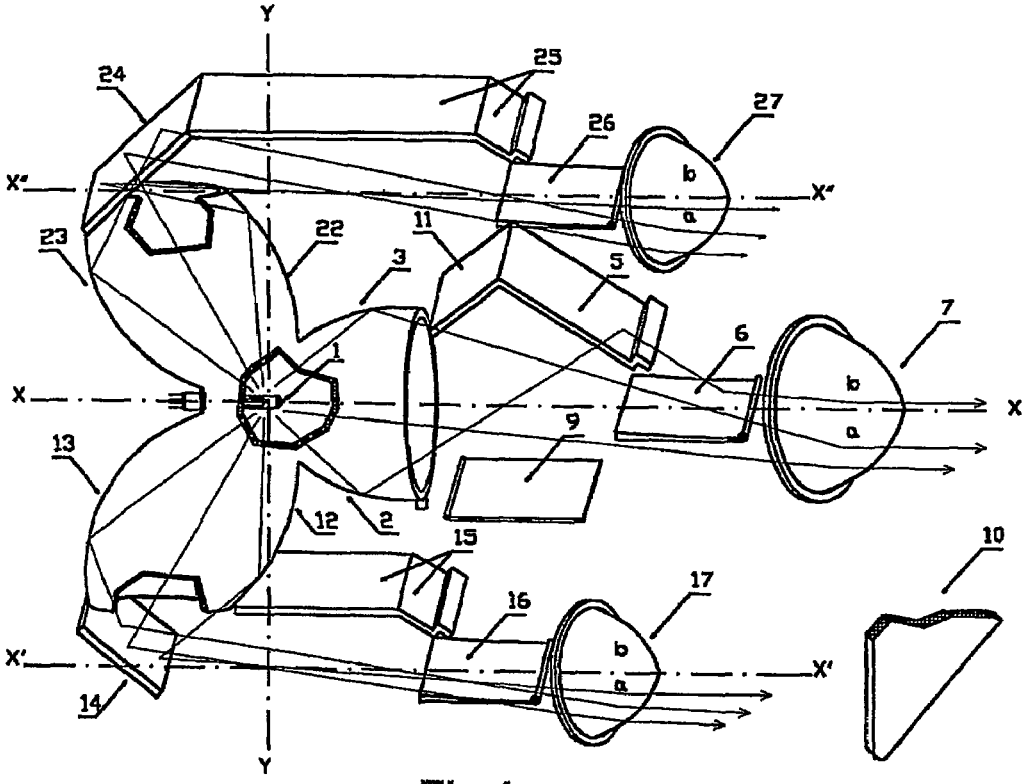
Figure 5:
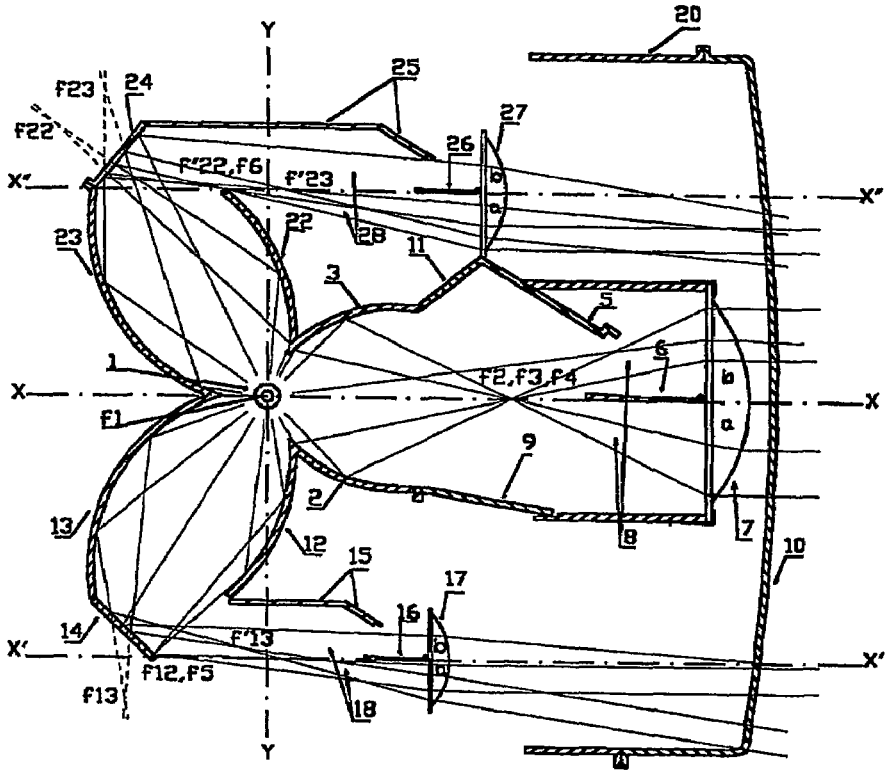
Figure 6:
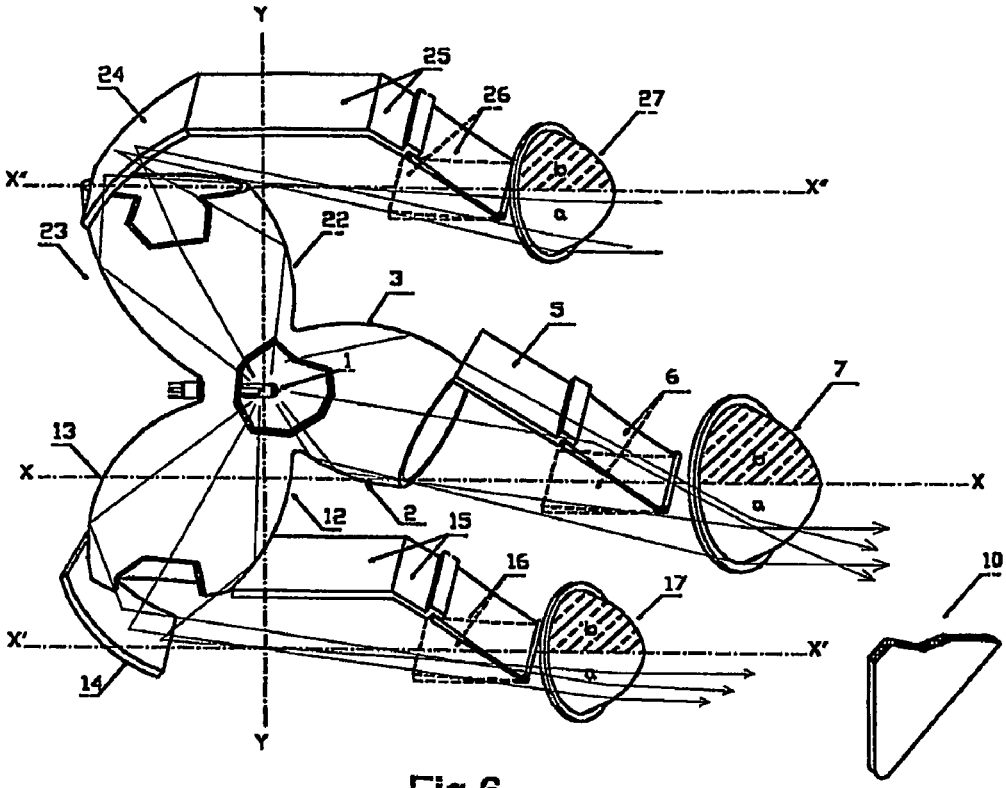
FIGS. 6 and 8 are perspective views showing the essential parts of a second preferred embodiment of this invention, consisting of one horizontally and two vertically disposed reflectors and triple light pathway, mounted in the form of a clover-leaf, with the semi-shutter piece in open and closed positions respectively.
Figure 7:
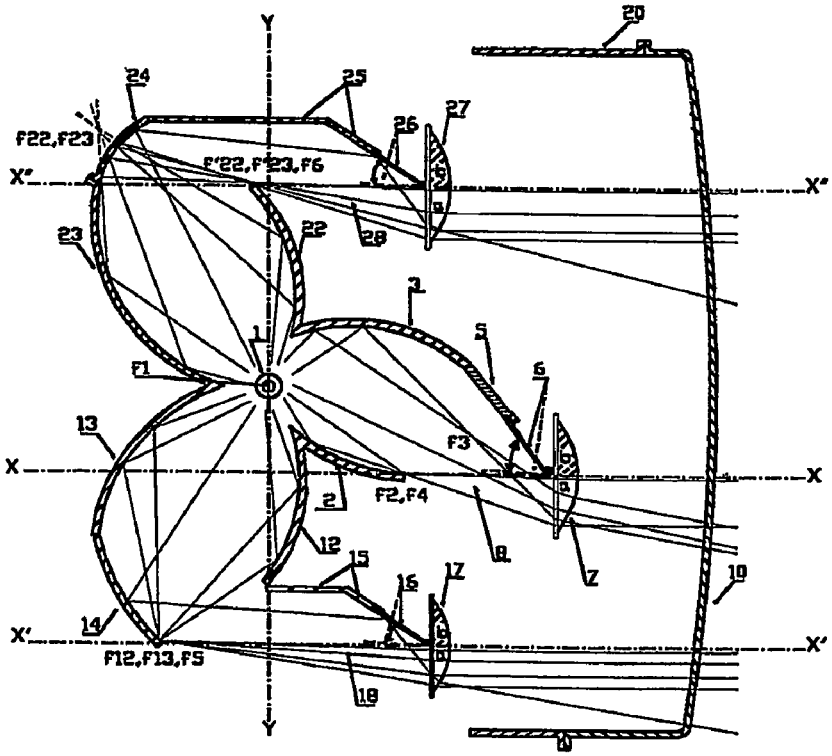
FIGS. 7 and 9 are cross-sectional views in the vertical direction of FIGS. 6 and 8 above respectively.
Figure 8:
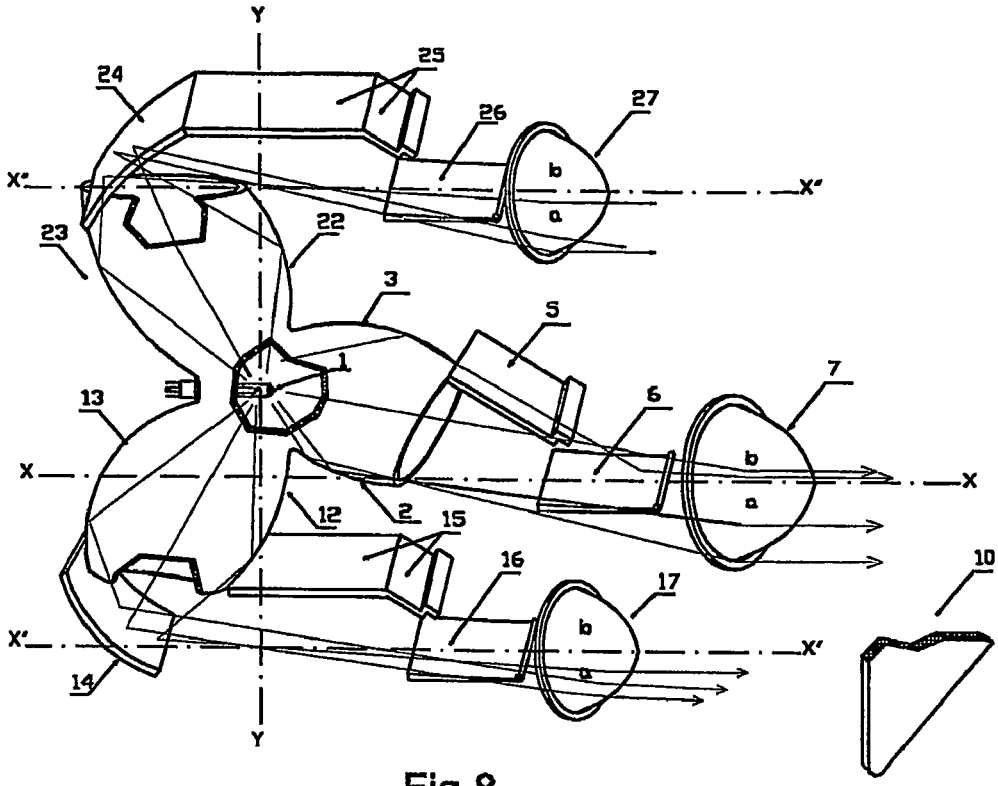
Figure 9:
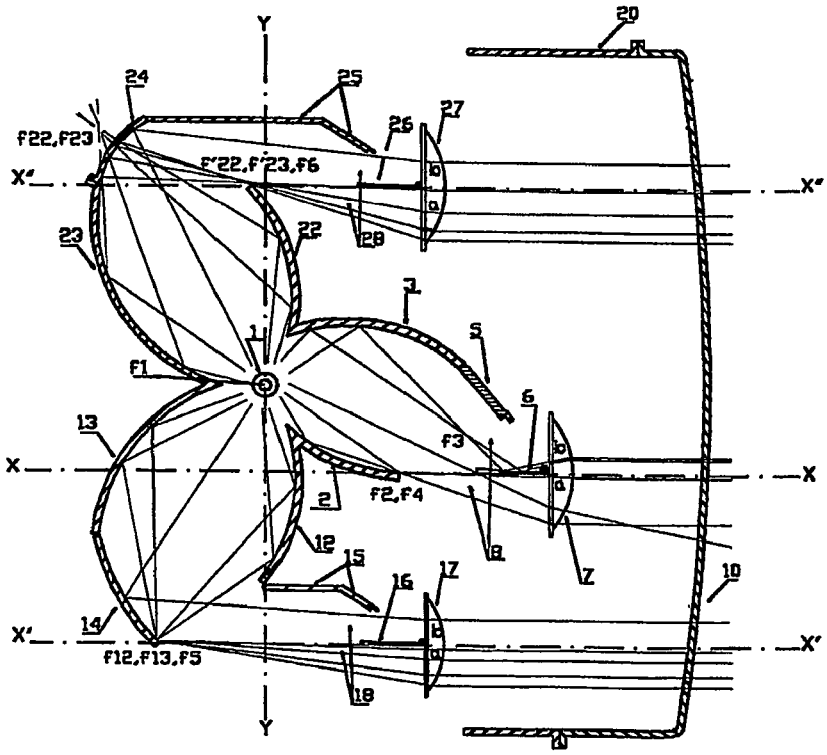

FIG. 1 summarizes briefly the main principle of operation of this invention, wherein XX represents the horizontal plane passing from the optical center of the plano-convex lens of the headlamp and is parallel to the road surface in all the figures given in this invention. EE represents the eye level of the oncoming traffic and it is normally above the XX line as shown in the FIG. 1, and YY represents the vertical axis to the road surface passing from the light source. FIG. 1 also shows the illumination zone and the beamless zone that are intended by the design presented in this invention. We note that the beamless zone is defined with respect to the light rays generated by the headlamp mounted on the vehicle, and some light rays reflecting from the road surface or from the environment may fall on this zone.

The design in this invention ensures that the light beams do not pass above the horizontal XX light plane, thus remain lower than the eye level (EE horizontal line) oncoming traffic users or an observer looking from an opposite line, creating a completely non-glare headlamp system without reducing illumination on the road surface. Attention is drawn to the fact that the XX light plane may be slightly inclined towards the road surface in situations where the headlamp is mounted at higher levels normally such as trucks, land vehicles and the like.

As will be seen from the definitions of the preferred embodiments of the invention, the design in this invention can be applied in several different combinations without limitations, but in this section we will describe two basic examples of the preferred embodiments of the invention, together with some other versions.

FIGS. 2, 3, 4 and 5 show the basic parts and the principle of operation of a first embodiment of the headlamp in this invention, in the form of a clover-leaf, consisting of a single light source 1, a reflector group consisting of three reflector units, each of the said units looking forward 2,3, downward 12,13 and upward 22,23 respectively, and each reflector unit having its own light path assembly which will be described below in detail, a front lens 10 that is preferably a transparent lens and a headlamp housing 20 with fixing connections for the front lens.

The light source 1 used in this invention can be by any of standard light sources including incandescent, halogen, high intensity discharge (HID), light emitting diode (LED), fluorescent, and other types of lamps with sufficient light intensity approved internationally for motor vehicle applications without any limitations. Optical fiber based illuminations can also be used in the system as the light source. The light source 1 is so disposed that the filament or the discharge space of the said light source 1 is located near the common first focus f1 of each reflector unit.

The reflector units of the reflector group are preferably elliptic or combined elliptic forms but other forms such as parabolic, cylindrical, ellipsoid or similar shapes with preferably plurality face, or combinations of any of these types with others can also be used, with curvatures of the said reflector surfaces being also adjustable freely depending on need or preference. The surfaces of said reflector units are made of any known materials generally used for reflective surfaces including metals, plastics, fiber-based materials or similar materials coated with a bright reflective substance, such as aluminum etc. Boron compounds may be used in order to improve the resistance against heat and shocks in reflective surfaces and in glass lenses.

The forward-looking part of the first embodiment (FIGS. 2, 3, 4 and 5) consists of reflector sections 2 and 3, a shield 9, a reflective surface 11, a flat mirror 5, a semi-shutter 6, a plano-convex lens 7, and an opening 8 for light passage.

The reflector sections 2 and 3 are so disposed that the light source 1 is located near the first focus of the said reflector sections 2 and 3. The second focal points f2 and f3 respectively of the reflector sections 2 and 3 are located near the middle section of the upper edge of the shield 9, which is also the focal point f4 of plano-convex lens 7. Therefore, the light rays received by upper reflector section 3 are focused at the common f2,f3,f4 focal point and fall on the lower half 7*a* of the plano-convex lens 7. These light rays are always projected by lower half 7*a* of the piano-convex lens 7, so that they are parallel to and under the XX horizontal plane (within illumination zone), thus forming the long-distance illumination. The light rays received by lower reflector section 2 are focused on f2,f3,f4 common focal point and fall on the semi-shutter 6 in normal operation when the semi-shutter 6 is closed (covering the upper half-lens 7*b*), and therefore, these light rays cannot reach the upper lens 7*b* and they are reflected by semi-shutter 6 to the lower half 7*a* of the plano-convex lens 7. These light rays are projected by lower half 7*a* of the plano-convex lens 7, so that they are inclined towards the road surface and under the XX horizontal plane (within illumination zone), thus forming the short-distance illumination.

The shield 9 is a movable part, disposed at an angle of approximately 45°, so that its upper edge coincides with the XX plane. Said movable shield 9 prevents the lower reflector section 2 from being seen by opposite traffic, and besides, enables the utilization of the lights falling onto itself thanks to its reflective inner surface. The inner surface of the said shield 9 is made reflective so that it reflects all the light rays falling onto itself to the reflective surface 11. Said reflective surface 11 is disposed at the front edge of the reflector section 3, and is positioned opposite to the reflecting shield 9, and it directs the said light rays to the lower half 7*a* of piano-convex lens 7. These light rays are projected by lower half-lens 7*a*, so that they are inclined towards the road surface.

The flat mirror 5 is positioned at the front edge of the reflective surface 11, and is connected to the upper edge of the semi-shutter 6. The function of the said flat mirror 5 is to direct the light rays failing onto itself towards the lower half 7*a* of the piano-convex lens 7, which are projected by lower half-lens 7*a*, so that they are inclined towards the road surface.

The semi-shutter 6 is a movable part, disposed at an inclined position, with reflecting inner and concave outer surfaces. The basic function of semi-shutter 6 and of the flat mirror 5 together is to prevent light rays falling on the upper half-lens 7*b*, to direct light rays falling onto themselves towards lower half-lens 7*a* and to also prevent the upper reflector section 3 from being seen by the opposite traffic. Said movable semi-shutter 6 is fixed at its lower edge to the frame enclosing the lens 7 with a folding mechanism that can be controlled manually or electronically from the dashboard. The lower edge of the semi-shutter is on the horizontal XX plane dividing the lens 7 into lower 7*a* and upper 7*b* halves. The upper edge of the semi-shutter 6 sits on the lower edge of the flat mirror 5, fully tight to prevent light leaks, with a suitable latch mechanism to prevent the semi-shutter 6 passing beyond the outer surface of the said flat mirror 5.

When the semi-shutter 6 is in open position (parallel to XX axis, FIGS. 4 and 5), the light rays received from reflector section 2 are focused at f2 second focal point and fall on the upper half 7*b* of the plano-convex lens 7. The outer concave surface of the said semi-shutter is so designed that it reflects the light rays falling onto itself towards the upper half 7*b* of the plano-convex lens 7, which are then projected towards the road surface. At the same time, the light rays coming from reflector sections 2 and 3 fall on the whole of the plano-convex lens 7 (7*a* and 7*b* halves) and all these light rays are projected parallel to and under the XX horizontal plane (within illumination zone) thus acting as a conventional high-beam illumination, giving a warning or an indicator signal.

Bottom right or left sections of the semi-shutter piece may be designed to create a cut-off line, so that certain sections of the upper half, receive light rays from the center of the plano-convex lens, and thus more areas on the right or left side of the vehicle are illuminated, depending on the traffic direction being on the right or left at certain angles, in order to increase visibility of traffic signs and road sides.

This shield 9 and semi-shutter 6 are so adjusted that the light rays received by both reflector sections 2 and 3 are directed towards the lower half-lens 7*a* through the opening 8 between the shield 9 and semi-shutter 6. Therefore, neither the light source and nor any of the reflecting surfaces can be seen by oncoming traffic, preventing the light rays projected by the plano-convex lens 7*a* from reaching to the eye level EE (FIGS. 1, 2 and 3) of the opposite traffic.

The shield 9 and the semi-shutter 6 operate in connection, and when both are in open position, the light path of the reflector becomes completely unobstructed and all the light rays fall on the plano-convex lens 7.

The plano-convex lens 7 has a flat back surface and an aspherical front surface, and it is suitable for the purpose of collecting and projecting the light rays to the desired direction. The XX horizontal plane that passes from the optical center of said lens 7 divides it into two halves as the lower half 7*a* and the upper half 7*b*.

The opening 8 is located between shield 9 and semi-shutter 6 and allows all the generated lights to pass towards the road surface. In normal operation (when semi-shutter is closed, FIGS. 2 and 3), the lower edge of the semi-shutter forms the upper edge of the opening 8. In such a case, the non-reflective outer surface of shield 9 forms the opening wall. When semi-shutter is in open position (FIGS. 4 and 5), the lower edge of the flat-mirror 5 forms the upper edge of the opening 8 and all the inner space of the headlamp acts as the opening.

The downward-looking part of the first embodiment (FIGS. 2, 3, 4 and 5) consists of reflector sections 12 and 13, a mirror-reflector 14, a flat mirror 15, a plano-convex lens 17, and an opening 18 for light passage. In this part of the preferred first embodiment, the reflector sections 12 and 13 are so disposed that the light source 1 is located near the first focus of the said reflector sections 12 and 13.

The second focus f12 of front reflector section 12 is located near the lower edge of mirror-reflector 14 and therefore the light rays generated from the light source 1 on the reflector section 12 are focused at f12 focal point, which is located on or above XX horizontal plane. The second focus f13 of the rear reflector section 13 is normally located behind the mirror-reflector 14, but the mirror-reflector 14 is so disposed that this focal point f13 is moved to f'13 image, which is located somewhere between the common focus f12,f5 and the plano-convex lens 17. This focal image f'13 is so adjusted that all the light rays passing from this focal image f'13 fall on the lower half 17*a* of plano-convex lens 17. These light rays are then projected by the lens 17*a* as a light beam inclined towards the road surface so that they always remain under X'X' horizontal plane (within illumination zone) as short-distance illumination.

The mirror-reflector 14 is a flat mirror or it may be a parabolic, cylindrical or a combination thereof, and is used to reflect the light rays received from the light source 1 and from reflector sections 12, 13 towards the lower half 17*a* of the plano-convex lens 17.

The said mirror-reflector 14 is disposed at the lower edge of rear reflector section 13 in an inclined manner, so that the lower edge of said mirror-reflector 14, f12 second focal point of reflector section 12 and the focal point f5 of plano-convex lens 17 coincide at the same point f12,f5, which is on X'X' horizontal axis. The said lower edge of mirror-reflector 14 is also the focal point f5 of the plano-convex lens 17, and the light rays focused at the said focal point f12 are directed towards lower half 17*a* of the plano-convex lens 17. Therefore, these light rays are projected by the lower half 17*a* of the plano-convex lens 17 parallel to X'X' plane and remain always under X'X' horizontal plane (within illumination zone), creating long-distance illumination.

The flat mirror 15 is disposed at the front edge of reflector section 12 and it is connected to the semi-shutter piece 16. Said flat mirror 15 and semi-shutter 16 have the same shape, properties and functions as given in the forward-looking part above The plano-convex lens 17 also has the same shape, properties and functions as given in forward-looking part above.

The headlamp opening 18 located in the front section of the headlamp casing looking towards the road is made in such a shape and size that it allows all the generated light rays to pass towards the road surface. The inner surfaces of this opening 18 can be painted with a non-reflective paint or may be coated with a suitable material.

The upward-looking part of the first embodiment (FIGS. 2, 3, 4 and 5) consists of reflector sections 22 and 23, a mirror-reflector 24, a flat mirror 25, a semi-shutter 26, a plano-convex lens 27 and an opening 28 for light passage.

In this part of the preferred first embodiment, the reflector sections 22 and 23 are so disposed that the light source 1 is located near the first focus of the said reflector sections 22 and 23. The second focus f22 of front reflector section 22 is normally located behind the mirror-reflector 24, but the said mirror-reflector 24 is so disposed that this focal point f22 is moved to f'22 image on the upper edge of the reflector section 22, which is on the horizontal X"X" plane parallel to road surface and also the focus f6 of plano-convex lens 27. Therefore, the light rays focused at this common focal point f'22,f6 fall on the lower half 27*a* of plano-convex lens 27, and they are then projected by the half-lens 27*a* as a parallel light beam, remaining always under X"X" horizontal plane (within illumination zone) as long-distance illumination. The second focus f23 of rear reflector section 23 is also normally located behind the mirror-reflector 24, but the mirror-reflector 24 is so disposed that f'23 image of this focal point f23 is moved somewhere between the upper edge of the reflector section 22 and the plano-convex lens 27. This focal image f'23 is so adjusted that all the light rays passing from said focal image f'23 fall on the lower half 27*a* of piano-convex lens 27. These light rays are then projected by the half-lens 27*a* as a light beam inclined towards the road surface so that they remain under the said X"X" plane (within illumination zone) as short-distance illumination.

The mirror-reflector 24 is a flat mirror, or it may be a parabolic, cylindrical or a combination thereof, and is used to reflect the light rays received from the light source 1 and from reflector sections 22,23 towards the lower half 27*a* of the plano-convex lens 27.

The flat mirror 25 is disposed at the front edge of mirror-reflector 24 and it is connected to the semi-shutter piece 26. Said flat mirror 25 and semi-shutter 26 have the same shape, properties and functions as given in the forward-looking part above.

The plano-convex lens 27 also has the same shape, properties and functions as given in the first embodiment forward-looking part above.

The headlamp opening 28, located in the front section of the headlamp casing looking towards the road, is made in such a shape and size that it allows all the generated light rays to pass towards the road surface. The inner surfaces of this opening 28 can be painted with a non-reflective paint or may be coated with a suitable material.

This first preferred embodiment may be used in various versions without any limitations with respect to form and location of the reflectors, some examples of which will be shown in this section below.

Figure 10:
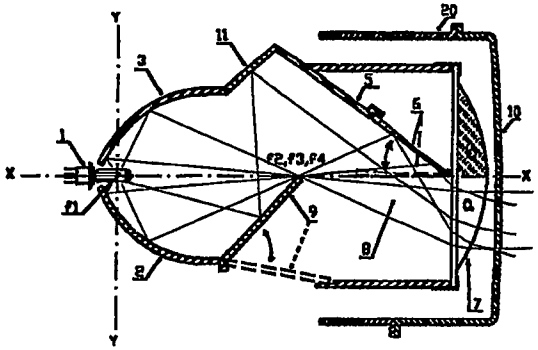
FIG. 10 is the cross-sectional view in the vertical direction of the forward-looking unit of a first preferred embodiment in this invention, used as a separate version, with the semi-shutter is in closed position.

FIG. 10 shows a single-reflector headlamp version, wherein the forward-looking part of the first embodiment is used with an independent light source and with other inner parts having the same design, properties and functions and operational principle as given therein.

Figure 11:
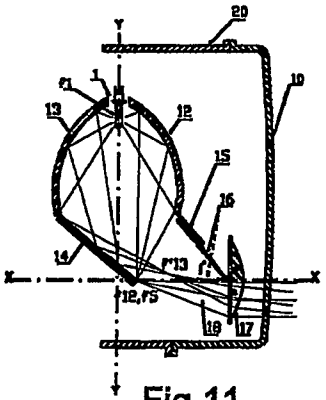
FIG. 11 is the cross-sectional view in the vertical direction of the downward-looking unit of a first preferred embodiment in this invention, used as a separate version, with the semi-shutter in closed position.

FIG. 11 shows a single-reflector headlamp version, wherein the downward-looking part of the first embodiment is used, with an independent light source and with other inner parts having the same design, properties, functions and operational principle as given therein. In this design, the reflector unit may also be disposed at inclined positions towards front or back, provided that the mirror-reflectors are placed at appropriate angles.

Figure 12:
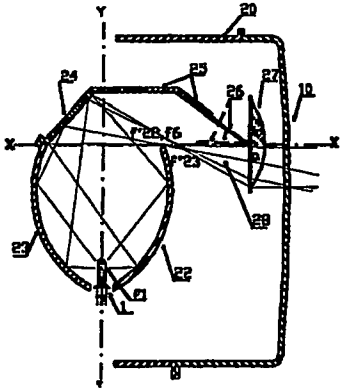
FIG. 12 is the cross-sectional view in the vertical direction of the upward-looking unit of a first preferred embodiment in this invention, used as a separate version, with the semi-shutter in closed position.

FIG. 12 shows a single-reflector headlamp version, wherein the upward-looking part of the first embodiment is used with an independent light source and with other inner parts having the same design, properties, functions and operational principle as given therein.

In this design, the reflector unit may also be disposed at inclined positions towards front or back, provided that the mirror-reflectors are placed at appropriate angles.

FIGS. 6, 7, 8 and 9 show the basic parts and the principle of operation of a second embodiment of the headlamp in this present invention, in a form similar to clover-leaf, consisting of a single light source 1, a reflector group consisting of three reflector units, each unit looking forward 2,3, downward 12,13 and upward 22,23 respectively, each of the said reflector units having its own light pathway which will be described below in detail, a front lens 10 that is preferably a transparent lens and a headlamp housing 20 with fixing connections for the front lens.

The common light source 1 can be any type defined in the first embodiment, and it is so disposed that the filament or the discharge space of the said light source 1 is located near the common first focus f1 of each reflector unit.

The forward-looking part of the second embodiment (FIGS. 6, 7, 8 and 9) consists of reflector sections 2 and 3, a flat mirror 5, a semi-shutter 6, a piano-convex lens 7, and an opening 8 for light passage.

In this part of the second preferred embodiment, the reflector sections 2 and 3 are so disposed that the light source 1 are located near the first focus of the said reflector sections 2 and 3. The lower reflector section 2 is so designed that the front edge of the said reflector section 2 coincides with the second focus f2 of the reflector section 2 and at the same time with the focal point f4 of the plano-convex lens 7. This common second focus f2,f4 is located on XX horizontal axis that is parallel to the road surface, passing through the optical center of the plano-convex lens 7 dividing the said lens 7 into two halves as 7*a* and 7*b*. The said plano-convex lens 7 has the same properties and form given in the first embodiment. The second focus f2 and the front edge of the reflector section 2 are on the XX horizontal plane. This arrangement ensures that all the light rays reflected from the reflector section 2 are focused at f2,f4 focal point and fall on the lower half 7*a* of the plano-convex lens 7. These light rays are then projected by the half-lens 7*a* as a light beam parallel and under the said XX plane (within illumination zone), thus forming the long-distance illumination.

The upper reflector section 3 is so designed that all the light rays received from the light source 1 are reflected and focused at the second focus f3 of reflector section 3. This focal point f3 is located between common focal point f2,f4 and the plano-convex lens 7. This focal point f3 is so designed that all the light rays passing from f3 focus fall also on the lower half 7*a* of piano-convex lens 7. Thus, these light rays are then projected by the lower half-lens 7*a* as a light beam inclined towards the road surface, so that they remain under the said XX plane (within illumination zone) as short-distance illumination.

The flat mirror 5 is positioned at the front edge of reflector section 3 and is connected to the semi-shutter 6; the said semi-shutter 6 is a movable part in the form of a flat reflecting inner surface and a concave outer surface, designed in such a way that it acts the same as given in the first embodiment.

The movable semi-shutter 6 is fixed at its lower edge to the frame enclosing the lens 7 with a folding mechanism that can be controlled manually or electronically from the dashboard. The lower edge of the semi-shutter is on the horizontal XX plane dividing the lens 7 into upper 7*b* and lower 7*a* halves. The upper edge of the semi-shutter 6 sits on the lower edge of the flat mirror 5, fully tight to prevent light leaks, with a suitable latch mechanism to prevent the semi-shutter 6 passing beyond the outer surface of the said flat mirror 5.

When the said semi-shutter 6 is in closed position (FIGS. 6 and 7), flat mirror 5 and semi-shutter 6 reflect all light rays scattering and falling over itself to the lower half-lens 7*a* without any loss within the headlamp assembly. When it is in open position (on XX horizontal plane, FIGS. 8 and 9), the light rays received from reflector section 3 and flat mirror 5 are reflected by the outer concave surface of the semi-shutter 6 and fall on the upper half-lens 7*b*. The outer concave surface of the said semi-shutter is so adjusted that the light rays reflected by reflector 3 fall on the upper half 7*b* of the plano-convex lens 7 and are projected as a parallel light beam towards the road surface. When the semi-shutter is open, the headlamp acts as a conventional high-beam illumination and is used to give a warning or an indicator signal.

Bottom right or left sections of the semi-shutter piece may be designed to create a cut-off line in the form and for the purposes as explained in the first embodiment.

The plano-convex lens 7 also has the same shape, properties and functions as given in the first embodiment forward-looking part above.

The headlamp opening 8 located in the front section of the headlamp casing looking towards the road is made in such a shape and size that it allows all the generated light rays to pass towards the road surface. The inner surfaces of this opening 8 can be painted with a non-reflective paint or may be coated with a suitable material.

The downward-looking part of the second embodiment (FIGS. 6, 7, 8 and 9) consists of reflector sections 12 and 13, a mirror-reflector 14, a flat mirror 15, a piano-convex lens 17, and an opening 18 for light passage.

In this part of the preferred second embodiment, the reflector sections 12 and 13 are so disposed that the light source 1 is located near the first focus of the said reflector sections 12 and 13.

The second focal points f12 and f13 respectively of reflector sections 12 and 13 are located near the lower edge of mirror-reflector 14 and therefore the light rays generated from the light source 1 on the reflector sections 12 and 13 are focused at this f12,f13 common focal point, which is located on or above XX horizontal plane.

The mirror-reflector 14 is a parabolic, cylindrical or a combination thereof, and is used to reflect the light rays received from the light source 1 and from reflector sections 12, 13 towards the lower half 17*a* of the plano-convex lens 17.

The said mirror-reflector 14 is disposed at the lower edge of rear reflector section 13 in an inclined manner, so that the lower edge of said mirror-reflector 14, the f12,f13 common second focal point of reflector sections 12 and 13, and the focal point f5 of piano-convex lens 17 coincide at the same point f12,f13,f5, which is on X'X' horizontal axis. The light rays focused at the said common focal point f12 and f13 are directed towards lower half 17*a* of the plano-convex lens 17. Therefore, these light rays are projected by the lower half 17*a* of the plano-convex lens 17 parallel to X'X' plane and remain always under X'X' horizontal plane (within illumination zone), creating the long-distance illumination.

The flat mirror 15 is disposed at the front edge of reflector section 12 and it is connected to the semi-shutter piece 16. Said flat mirror 15 and semi-shutter 16 have the same shape, properties and functions as given in the first embodiment above.

The plano-convex lens 17 and headlamp opening 18 also have the same shape, properties and functions as given in the first embodiment above.

The upward-looking part of the second embodiment (FIGS. 6, 7, 8 and 9) consists of reflector sections 22 and 23, a mirror-reflector 24, a flat mirror 25, a semi-shutter 26, a plano-convex lens 27 and an opening 28 for light passage.

In this part of the preferred second embodiment, the reflector sections 22 and 23 are so disposed that the light source 1 is located near the first focus of the said reflector sections 22 and 23.

The second focus f22 and f23 respectively of reflector sections 22 and 23 are normally located behind the mirror-reflector 24, which is a parabolic, cylindrical or a combination thereof. The said mirror-reflector 24 is so disposed that this common focal point f22 and f23 is moved to f'22 and f'23 image on the upper edge of the reflector section 22, which is on the horizontal X"X" plane parallel to road surface and which is also the focus f6 of piano-convex lens 27. Therefore, the light rays focused at this common focal point f'22, f'23, f6 fall on the lower half 27*a* of plano-convex lens 27, and they are then projected by the half-lens 27*a* as a parallel light beam, remaining always under X"X" horizontal plane (within illumination zone) as the long-distance illumination.

The flat mirror 25 is disposed at the front edge of mirror-reflector 24 and it is connected to the semi-shutter piece 26. Said flat mirror 25 and semi-shutter 26 have the same shape, properties and functions as given in the first embodiment above.

The plano-convex lens 27 and headlamp opening 28 also have the same shape, properties and functions as given in the first embodiment above.

This second preferred embodiment may be used in various versions without any limitations with respect to form and location of the reflectors, some examples of which will be shown in this section below.

Figure 13:
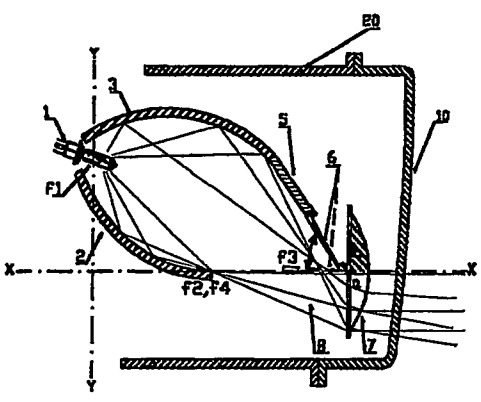
FIG. 13 is the cross-sectional view in the vertical direction of the forward-looking unit of a second preferred embodiment of this invention, used as a separate version, with the semi-shutter in closed position.

FIG. 13 shows a single-reflector headlamp system wherein the forward-looking part of the second embodiment is used, with an independent light source and with other inner parts having the same design, properties and functions as given in the forward-looking unit of the second embodiment, and with the same operational principle given therein.

Figure 14:
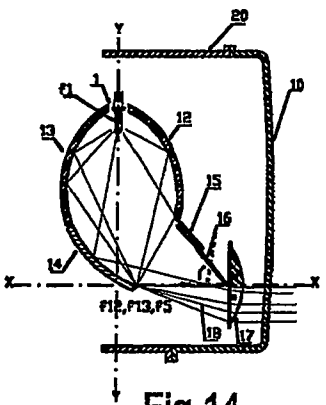
FIG. 14 is the cross-sectional view in the vertical direction of the downward-looking unit of a second preferred embodiment in this invention, used as a separate version, with the semi-shutter in closed position

FIG. 14 shows a single-reflector headlamp system wherein the downward-looking part of the second embodiment is used, with an independent light source, with other inner parts having the same design, properties and functions as given in the downward-looking unit of the second embodiment, and with the same operational principle given therein. In this design, the reflector unit may also be disposed at inclined positions towards front or back, provided that the mirror-reflectors are placed at appropriate angles.

Figure 15:
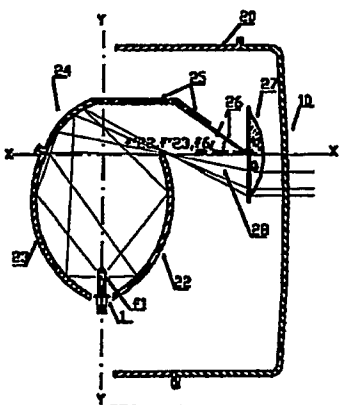
FIG. 15 is the cross-sectional view in the vertical direction of the upward-looking unit of a second preferred embodiment in this invention, used as a separate version, with the semi-shutter in closed position.

FIG. 15 shows a single-reflector headlamp system wherein the upward-looking part of the second embodiment is used, with an independent light source, with other inner parts having the same design, properties and functions as given in the upward-looking unit of the second embodiment, and with the same operational principle given therein. In this design, the reflector unit may also be disposed at inclined positions towards front or back, provided that the mirror-reflectors are placed at appropriate angles.

The versions described in FIGS. 10,11,12,13,14 and 15 may be used as double, triple or quadruple reflector forms together without any limitation of number or location direction, within the same headlamp assembly (figure not shown), with the reflector groups disposed side by side separated from each other, each group having a separate light source and a separate plano-convex lens disposed at appropriate positions, or they may be disposed in double, triple forms, or quadruple forms together within the same headlamp assembly with a common single light source.

The invention claimed is:

1. A headlamp comprising:

at least one light source;

at least one reflector section;

at least one shield;

at least one lens; and at least one semi-shutter, which is used for covering an upper half of said lens in order that light rays coming from said light source, from said at least one reflector section and/or and from all reflecting surfaces inside the headlamp are not transmitted through said lens at eye level of oncoming traffic users, wherein the locations of said shield, said semi-shutter and focal points of lens are so adjusted within the headlamp that the light rays are directed towards a lower half of said lens through an opening placed between an upper edge of the shield and a lower edge of the semi-shutter such that the lower half of the lens projects light rays to only road surfaces.

2. The headlamp according to claim 1, wherein said shield is a movable part and it is disposed an angle of approximately 45° with the XX horizontal plane and its inner surface is reflective.

3. The headlamp according to claim 1, wherein a bottom section of said semi-shutter and/or an upper edge of said shield is designed to create a cut-off section, in the form of a preferred cut-off type.

4. The headlamp according to claim 1, wherein said lower half lens which is used for projecting light rays is placed as a front and/or rear half lens according to its location of usage and preferred embodiment.

5. The headlamp according to claim 1, used in double reflector groups with double light pathways, or in triple reflector groups with triple light pathways (clover-leaf shape), or in more reflector groups with more light pathways.

6. The headlamp according to claim 1, wherein a full lens or half lens is used in place of said lens.

7. The headlamp according to claim 1, wherein said semi-shutter is a movable part and disposed an angle so as to project light rays coming from said shield to said lower half lens.

8. The headlamp according to claim 1, wherein an inner and/or outer surface of said semi-shutter is reflective.

9. The headlamp according to claim 1, wherein said lens is a plano convex type having a flat back surface and an aspherical front surface or a spherical, cylindrical shape or a combination thereof, or a Fresnel lens or any other type.

10. A headlamp comprising:

at least one light source;

at least one reflector section;

at least one inclined reflective shield;

at least one lens; and at least one reflective surface disposed in front of said at least one reflector section; and at least one semi-shutter which is used for covering an upper half of said lens in order that light rays coming from said light source, from said at least one reflector section, and from all reflecting surfaces inside the headlamp are not transmitted through said lens at eye level of oncoming traffic users, wherein said inclined shield and reflective surface are so adjusted that the reflective surface reflects the light rays coming from the reflective shield towards a lower half of the lens.

11. The headlamp according to claim 10, wherein said at least one reflective surface is flat or concave and is used to direct the light rays falling from said shield onto itself to the lower half lens.

12. The headlamp according to claim 10, wherein said shield is a movable part and is disposed an angle of approximately 45° with the XX horizontal plane, and its inner surface is reflective.

13. The headlamp according to claim 10, wherein a bottom section of said semi-shutter and/or an upper edge of said shield is designed to create a cut-off section, in the form of a preferred cut-off type.

14. The headlamp according to claim 10, wherein, where more than one reflective shield is provided, the reflection angles of an inner surface of each said inclined reflective shield is adjusted to reflect the light rays in accordance with said plurality of reflective shields.

15. The headlamp according to claim 10, wherein said lower half lens which is used for projecting light rays is placed as a front and/or rear half lens according to its location of usage and preferred embodiment.

16. The headlamp according to claim 10, used in double reflector groups with double light pathways, or in triple reflector groups with triple light pathways (clover-leaf shape), or in more reflector groups with more light pathways.

17. The headlamp according to claim 10, wherein said a full lens or half lens is used in place of said lens.

18. The headlamp according to claim 10, wherein said semi-shutter is a movable part and disposed an angle so as to project light rays coming from said shield to said lower half lens.

19. The headlamp according to claim 10, wherein an inner and/or an outer surface of said semi-shutter is reflective.

20. The headlamp according to claim 10, wherein said lens is a plano convex type having a flat back surface and an aspherical front surface or a spherical, cylindrical shape or a combination thereof, or a Fresnel lens or any other type.

21. A headlamp comprising:

at least one light source;

at least one reflector section;

at least one lens; and at least one semi-shutter, which is used for covering an upper half of said lens in order that light rays coming from said light source, from said at least one reflector section and from all reflecting surfaces inside the headlamp are not transmitted through said lens at eye level of oncoming traffic users, wherein the locations of lower edges of the at least one reflector section and the semi-shutter are so adjusted that the light rays are directed towards a lower half of the lens through an opening placed between the at least one reflector section and the lower edge of the semi-shutter such that the lower half of the lens projects light rays to only road suifaces.

22. The headlamp according to claim 21, wherein said lower half lens which is used for projecting light rays is placed as a front and/or rear half lens according to its location of usage and preferred embodiment.

23. The headlamp according to claim 21, used in double reflector groups with double light pathways, or in triple reflector groups with triple light pathways (clover-leaf shape), or in more reflector groups with more light pathways.

24. The headlamp according to claim 21, wherein said a full lens or half lens is used in place of said lens.

25. The headlamp according to claim 21, wherein said semi-shutter is a movable part and disposed an angle so as to project light rays coming from said shield to said lower half lens.

26. The headlamp according to claim 21, wherein an inner and/or an outer surface of said semi-shutter is reflective.

27. The headlamp according to claim 21, wherein said lens is a plano convex type having a flat back surface and an aspherical front surface or a spherical, cylindrical shape or a combination thereof, or a Fresnel lens or any other type.

28. A headlamp comprising:

at least one light source;

at least one reflector section;

at least one lens;

at least one mirror reflector; and at least one semi-shutter, which is used for covering an upper half of said lens in order that light rays coming from said light source, from said at least one reflector section and from all reflecting surfaces inside the headlamp are not transmitted through said lens at eye level of oncoming traffic users, wherein the locations of said mirror reflector and said semi-shutter are so adjusted that the light rays are directed towards a lower half of the lens through an opening placed between the mirror reflector and a lower edge of the semi-shutter such that the lower half of the lens projects light rays to only road surfaces.

29. The headlamp according to claim 28, wherein said mirror reflector is disposed against said reflector sections at an angle and it is flat or concave and the mirror reflector is so adjusted to reflect the light rays coming from the light source and reflective surfaces towards the lower half-lens.

30. The headlamp according to claim 28, wherein said lower half lens which is used for projecting light rays is placed as a front and/or rear half lens according to its location of usage and preferred embodiment.

31. The headlamp according to claim 28, used in double reflector groups with double light pathways, or in triple reflector groups with triple light pathways (clover-leaf shape), or in more reflector groups with more light pathways.

32. The headlamp according to claim 28, wherein said a full lens or half lens is used in place of said lens.

33. The headlamp according to claim 28, wherein said semi-shutter is a movable part and disposed an angle so as to project light rays coming from said shield to lower half lens.

34. The headlamp according to claim 28, wherein an inner and/or an outer surface of said semi-shutter is reflective.

35. The headlamp according to claim 28, wherein said lens is placed between the reflector sections and said mirror-reflectors, using one or more mirror-reflector within this design operating according to the indirect illumination principle.

36. The headlamp according to claim 28, wherein said lens is a plano convex type having a flat back surface and an aspherical front surface or a spherical, cylindrical shape or a combination thereof, or a Fresnel lens or any other type.

37. A headlamp comprising:

at least one light source;

at least one reflector section;

at least one lens;

at least one mirror reflector; and at least one semi-shutter, which is used for covering an upper half of said lens in order that light rays coming from said light source, from said at least one reflector section and from all reflecting surfaces inside the headlamp are not transmitted through the lens at eye level of oncoming traffic users, wherein the locations of said mirror reflector, said semi-shutter and said at least one reflector section are so adjusted that the light rays are directed towards a lower half of the lens through an opening placed between the reflector section and a lower edge of the semi-shutter such that the lower half of the lens projects light rays to only road surfaces.

38. The headlamp according to claim 37, wherein said mirror reflector is disposed against the reflector section at an angle and wherein said mirror reflector is flat or concave and is so adjusted to reflect the light rays coming from the light source and reflective surfaces towards the lower half-lens.

39. The headlamp according to claim 37, wherein said lower half lens which is used for projecting light rays is placed as a front and/or rear half lens according to its location of usage and preferred embodiment.

40. The headlamp according to claim 37, used in double reflector groups with double light pathways, or in triple reflector groups with triple light pathways (clover-leaf shape), or in more reflector groups with more light pathways.

41. The headlamp according to claim 37, wherein a full lens or half lens is used in place of said lens.

42. The headlamp according to claim 37, wherein said semi-shutter is a movable part and disposed an angle so as to project light rays coming from said shield to said lower half lens.

43. The headlamp according to claim 37, wherein an inner and/or an outer surface of said semi-shutter is reflective.

44. The headlamp according to claim 37, wherein said lens is placed between the reflector sections and said mirror-reflectors, using one or more mirror- reflector within this design operating according to the indirect illumination principle.

45. The headlamp according to claim 37, wherein said lens is a plano convex type having a flat back surface and an aspherical front surface or a spherical, cylindrical shape or a combination thereof, or a Fresnel lens or any other type.

46. A method for a long-distance illumination without glaring effects that uses a headlamp comprising at least one light source, at least one reflector section, at least a shield, and at least one lens, the method comprising the steps of:

covering with a semi-shutter an upper half of said lens in order to prevent the light rays coming from the light source, said at least one reflector section and all reflecting surfaces inside the headlamp from being transmitted through the upper half of the lens, locating said shield front of the reflector section in order to prevent at least some of the light rays reaching from said reflector section to said lens, adjusting said semi-shutter and said shield so that they establish a total concealment of said light source, said reflector sections and all reflecting surfaces inside the headlamp from an observer or oncoming traffic users looking above XX horizontal level so that the light rays pass through an opening placed between an upper edge of the shield and a lower edge of the semi-shutter and reach a lower half of the lens; and projecting the light rays to only road surfaces through the lower half of the lens but not projecting them up to the XX horizontal plane that the optical center of the lens.

47. A method for a long-distance illumination without glaring effects that uses a headlamp comprising at least one light source, at least one reflector section, and at least one lens, the method comprising the steps of:

covering with a semi-shutter an upper half of said lens in order to prevent the light rays coming from the light source, said at least one reflector section and all reflecting surfaces inside the headlamp from being transmitted through the upper half of the lens, locating a lower edge of the reflector section so that it is near the level of the optical center of the lens, adjusting said semi-shutter and said at least one reflector section so that they establish a total concealment of said light source and said reflector section from an observer or oncoming traffic users looking above XX horizontal level so that the light rays pass through an opening placed between the reflector section and a lower edge of the semi-shutter and reach a lower half of the lens; and projecting the light rays to only road surfaces through the lower half of the lens but not projecting them up to the XX horizontal plane that passes the optical center of the lens.

* * * * *